US007193588B2

(12) United States Patent
Lo

(10) Patent No.: US 7,193,588 B2
(45) Date of Patent: Mar. 20, 2007

(54) ACTIVE MATRIX ORGANIC ELECTROLUMINESCENCE DISPLAY DRIVING CIRCUIT

(75) Inventor: Shin-Tai Lo, Miaoli (TW)

(73) Assignee: Wintek Corporation, Taichung (TW)

( * ) Notice: Subject to any disclaimer, the term of this patent is extended or adjusted under 35 U.S.C. 154(b) by 635 days.

(21) Appl. No.: 10/671,452

(22) Filed: Sep. 29, 2003

(65) Prior Publication Data

US 2005/0068271 A1 Mar. 31, 2005

(51) Int. Cl.
*G09G 3/30* (2006.01)

(52) U.S. Cl. ..... 345/76; 345/55; 345/82; 315/169.1

(58) Field of Classification Search ..... 345/76, 345/82, 55, 92; 315/169.1, 169.3, 169.4; 340/815.45

See application file for complete search history.

(56) References Cited

U.S. PATENT DOCUMENTS 6,229,506 B1 * 5/2001 Dawson et al. ..... 345/82
6,373,454 B1 * 4/2002 Knapp et al. ..... 345/76
6,501,466 B1 * 12/2002 Yamagishi et al. ..... 345/204
6,747,638 B2 * 6/2004 Yamazaki et al. ..... 345/207
6,753,655 B2 * 6/2004 Shih et al. ..... 315/169.3
6,778,151 B2 * 8/2004 Li ..... 345/55
2003/0067424 A1 * 4/2003 Akimoto et al. ..... 345/55

OTHER PUBLICATIONS

D. Fish et al: SID 02 Digest, 32.1: Invited Paper, (2002) pp. 968-971.

* cited by examiner

*Primary Examiner*—Richard Hjerpe
*Assistant Examiner*—Kimnhung Nguyen
(74) *Attorney, Agent, or Firm*—Birch, Stewart, Kolasch and Birch, LLP

(57) ABSTRACT

A driving circuit of active matrix organic electroluminescence display is disclosed. Each pixel includes four TFTS and two capacitors. A gate of scan TFT is controlled by the scan line of the row where the pixel is located and a drain of scan TFT is connected to the data line of the column where the pixel is situated. Reset TFT and detect TFT are controlled by one threshold-lock line. One capacitor Cd is used to store data voltage (Vdata) of image signals and the other capacitor Ct is used to store threshold voltage (Vth) of drive TFT. Therefore, the sum of capacitors Cd and Ct will drive TFT to output a corresponding current to the organic electro luminescence element.

5 Claims, 6 Drawing Sheets

ACTIVE MATRIX ORGANIC ELECTROLUMINESCENCE DISPLAY DRIVING CIRCUIT

FIELD OF THE INVENTION

This invention relates to a driving circuit of active matrix organic electroluminescence display. More particularly, the invention is directed to a driving device and method that improve the non-uniform phenomena on an active matrix organic light-emitting diode display panel.

BACKGROUND OF THE INVENTION

OLED Display can be classified according to its driving method, passive-matrix (PMOLED) and active-matrix (AMOLED). AMOLED uses TFT (Thin Film Transistor) with a capacitor for storing data signals that can control OLED levels of brightness.

Manufacturing procedure of PMOLED is simpler in comparison and is less costly of the two; however, it is limited in its size (<5 inch) because of its driving mode and has a lower-resolution display application. In order to produce an OLED display with higher resolution and larger size, utilizing active-matrix driving is necessary. The so-called AMOLED uses TFT (Thin Film Transistor) with a capacitor for storing data signals, so that pixels can maintain its brightness after line scanning; on the other hand, pixels of passive matrix driving only light up when scan line selects them. Therefore, with active matrix driving, the brightness of OLED is not necessarily ultra-bright, resulting in longer lifetime, higher efficiency and higher resolution. Naturally, TFT-OLED with active matrix driving is suitable for display application of higher resolution and excellent picture due to the unique qualities of OLED.

LTPS (Low Temperature Poly-Silicon) and a-Si (amorphous Silicon) are both technologies of TFT integrating on glass substrate. The obvious differences are electric characteristics and complexity of process. Although LTPS-TFT possesses higher carrier mobility and higher mobility means more current can be supplied, the process is much more complex. However, the process of a-Si TFT is simpler and maturer, except for low carrier mobility. Therefore, a-Si process has better competitive advantages in cost.

Due to limitations of LTPS process capability, threshold voltage and mobility of TFT elements produced vary leading to different properties of each TFT element. When the driving system achieves gray scale by analog voltage modulation, OLED produces different output current despite of the same data voltage signal input due to different TFT characteristics of various pixels. Therefore, luminance of OLED varies. Images of erroneous gray scale will show up on OLED panel and damage image uniformity seriously.

The most urgent problem of AMOLED to be solved currently is how to reduce bad impact of uneven LTPS-TFT characteristics. Such issue requires immediate solution for follow-up development and application since images on the display tell the difference.

U.S. Pat. No. 6,229,506 discloses an Active Matrix Light Emitting Diode Pixel Structure And Concomitant Method. A 4T2C (4 TFTS and 2 capacitors) pixel circuit is proposed as shown in FIG. 4. An Auto-Zero mechanism is applied to compensate for the threshold voltage differences of TFT elements to improve uniformity of images. Driving sequences of control signals include Auto-Zero Phase 510, Load Data Phase 520 and Illuminate Phase 530. Refer to FIG. 5 for the sequences of control signals in FIG. 4.

Transistors T3 and T4 are off and Transistor T2 is on prior to Auto-Zero Phase 510. The current passing through OLED 460 at this moment is current of the previous frame and controlled by Vsg of Transistor T1 (voltage difference between source and gate; i.e., voltage difference of both ends of Cs).

After entering Auto-Zero Phase 510, Transistor T4 is on and then Transistor T3 is on, too so that Drain and Gate of Transistor T1 can be connected as a diode. As Transistor T2 is off, gate voltage of Transistor T1 will increase, which equals to Vdd minus threshold voltage (Vth) of Transistor T1. That is to say, the voltage difference stored at both ends of capacitor Cs is the threshold voltage of Transistor T1. After placing Transistor T3 off, threshold voltage (Vth) of Transistor T1 can be stored into capacitor Cs and Auto-Zero Phase 510 is completed.

On Load Data Phase 520, when voltage difference of Date Line 410 is ÄV, it can couple to the gate of Transistor T1 through Transistor T4 and capacitor Cc. Thus, voltage difference stored at both ends of capacitor Cs will be ÄV×[Cc/(Cc+Cs)] adding Vth that is stored in capacitor Cs previously. That is, Vsg of Transistor T1 includes Vth of Transistor T1, which makes output current of Transistor T1 relate to voltage change (ÄV) of Data Line 410 only, instead of being affected by Vth of transistor in every pixel.

Last when Illuminate Phase 530 begins, Transistor T4 is off and Transistor T2 is on. Output current of Transistor T1 at the present frame will flow through OLED 460 to illuminate.

Though this 4T2C pixel circuit may compensate for the threshold voltage (Vth) differences of transistor elements in each pixel and improve integral uniformity of images; however, other control lines like Auto-Zero Line 430 and Illuminate Line 440 are required in addition to Data Line 410, Scan Line 420 and Supply Line (Vdd) 450. Capacitor Cs has to record all threshold voltages and part of data voltages loaded. Besides, capacitance coupling approach is used to load data, which not only makes driving method more complicated, but also increases manufacturing cost when non-standard data driving IC is required.

To solve the same problem, Philips also published a thesis with the subject of A Comparison of Pixel Circuits for Active Matrix Polymer/Organic LED Displays. One 4T2C pixel circuit is presented in the thesis as FIG. 6 shows. It skillfully changes the location of connecting two capacitors in the pixel circuit of the U.S. Pat. No. 6,229,506 (FIG. 4) to solve the defects causing by complexity and impracticability. However, control lines like Auto-Zero Line 630 and Illuminate Line 640 are also required in addition to Data Line 610, Scan Line 620 and Supply Line (Vdd) 650.

The sequences of driving control signals are the same as the U.S. Pat. No. 6,229,506 since they consist of Auto-Zero Phase 510, Load Data Phase 520 and Illuminate Phase 530. Please refer to FIG. 5 and the sequences of control signals in FIG. 6.

On Auto-Zero Phase 510, Transistor T64 is off and then Transistor T63 is on so that Drain and Gate of Transistor T61 can be connected as a diode. As Transistor T62 is off, gate voltage of Transistor T61 will increase, which equals to Vdd minus threshold voltage (Vth) of Transistor T61. That is to say, the sum of voltage stored at capacitors C1 and C2 is the threshold voltage (Vth) of Transistor T61. After placing Transistor T63 off, Auto-Zero Phase 510 is completed.

Data voltage is conducted through connection of Transistor T64. Data voltage is stored in Capacitor C1 and a certain proportion of Vth previously stored at both ends of Capacitor C2 is still maintained, which equals to [C1/(C1+C2)]×

Vth. Thus, the sum of capacitors C1 and C2 is (Vdd−Vdata+[C1/(C1+C2)]×Vth); i.e., Vsg of Transistor T61 contains part of Vth of Transistor T61, which may not only reduce the correlation between the output current and threshold voltage of Transistor T61, but also compensate for part of the threshold voltage (Vth) difference resulted from process factors. The threshold voltage of Transistor T61 in the thesis is memorized by two capacitors (C1 & C2). Part of threshold voltage data stored in one of the capacitors will get lost while loading data voltage. Therefore, this approach can only make up for part of threshold voltage difference resulted from process.

SUMMARY OF THE INVENTION

The main purpose of this invention is to solve the aforementioned problems existed for a long time. As the critical component parts of AMOLED like TFT-OLED Data IC are not well developed, the well developed technology of TFT-LCD Source IC can be applied to support TFT-OLED application. However, TFT-LCD Source IC adopts voltage modulation; thus, design of a voltage driving circuit is required.

Hence, a voltage type of AMOLED driving circuit that can compensate for TFT threshold voltage variations is presented in this invention so as to improve image defects resulted from uneven characteristics of TFT.

To achieve the objective above, a driving device of each pixel presented in this invention includes 4 TUFTS and 2 capacitors, which are 1 scan TFT, 1 reset TFT, 1 detect TFT, 1 drive TFT, 2 capacitors (Cd & Ct) and 1 organic electro-luminescence element. The gate of scan TFT is controlled by the scan line of the row where the pixel is located and the drain of scan TFT is connected to the data line of the column where the pixel is situated. Reset TFT and detect TFT are controlled by one threshold-lock line. Capacitor Cd is used to store data voltage (Vdata) of image signals and capacitor Ct is used to store threshold voltage (Vth) of Drive TFT. Therefore, the sum of voltage stored in capacitors Cd and Ct will force Drive TFT to output an corresponding current to the organic electro luminescence element.

DETAILED DESCRIPTION OF THE PREFERRED EMBODIMENTS

Figure 1:
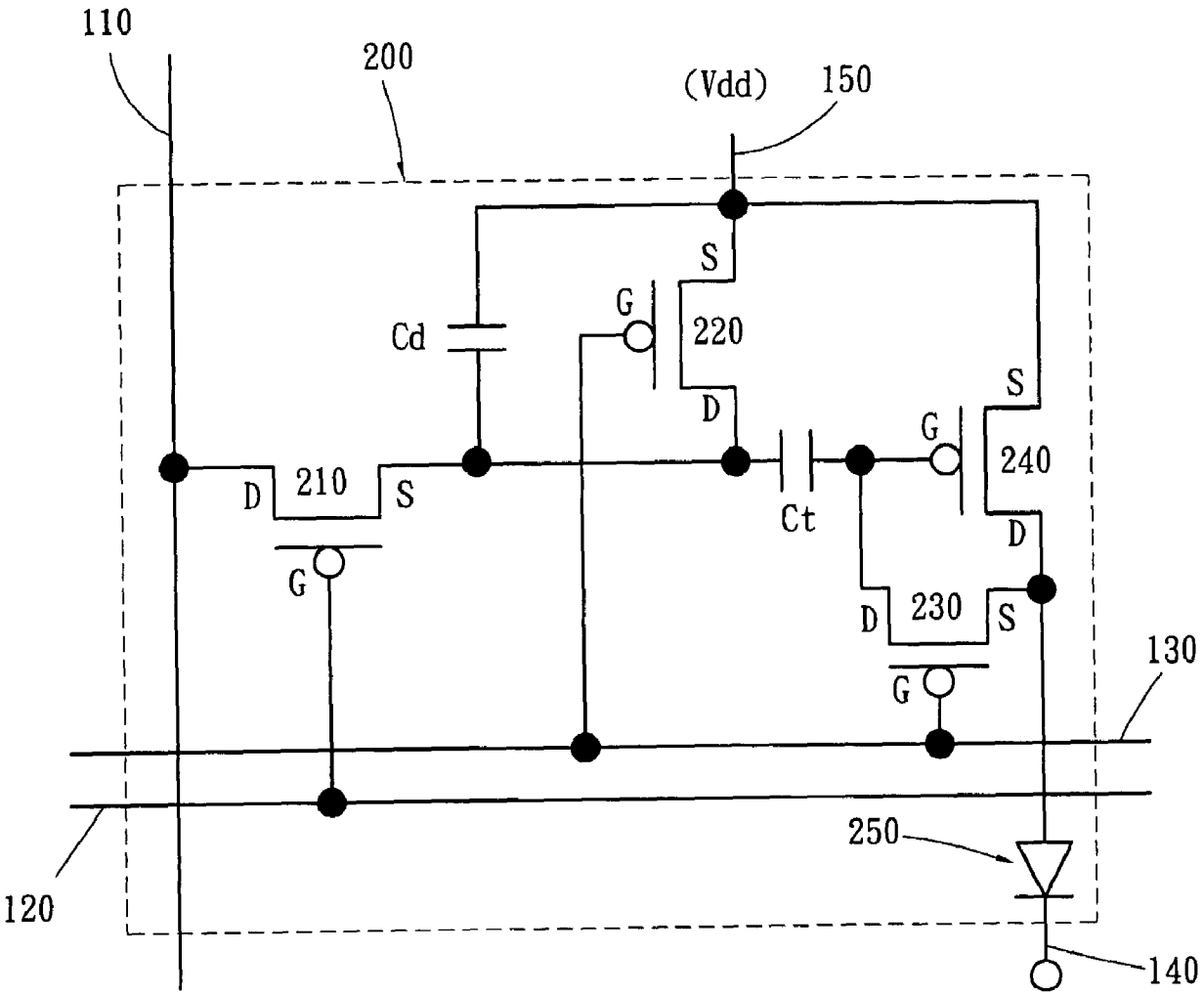
FIG. 1 is the circuit of each pixel in this invention.

Refer to FIG. 1 for the circuit of each pixel in this invention. As the Figure shows: the driving circuit of pixel 200 includes 4 TFTS and 2 capacitors connected as follows:

Gate of a Scan TFT 210 connected to one Scan Line 120 and drain connected to a Data Line 110.

Gate of a Reset TFT 220 connected to a Threshold-Lock 130, source connected to a Supply Line 150 and drain connected to source of Scan TFT 210.

Two ends of Capacitor Cd installed between source of Scan TFT 210 and source of Reset TFT 220.

Source of Drive TFT 240 connected to Supply Line 150.

Gate of Detect TFT 230 connected to Threshold-Lock 130, drain connected to the gate of Drive TFT 240 and source connected to the drain of Drive TFT 240.

Two ends of Capacitor Ct installed between drain of Reset TFT 220 and gate of Drive TFT 240.

Anode of an organic electro luminescence element 250 connected to the drain of Drive TFT 240 and cathode connected to a Common Line 140.

Figure 2:
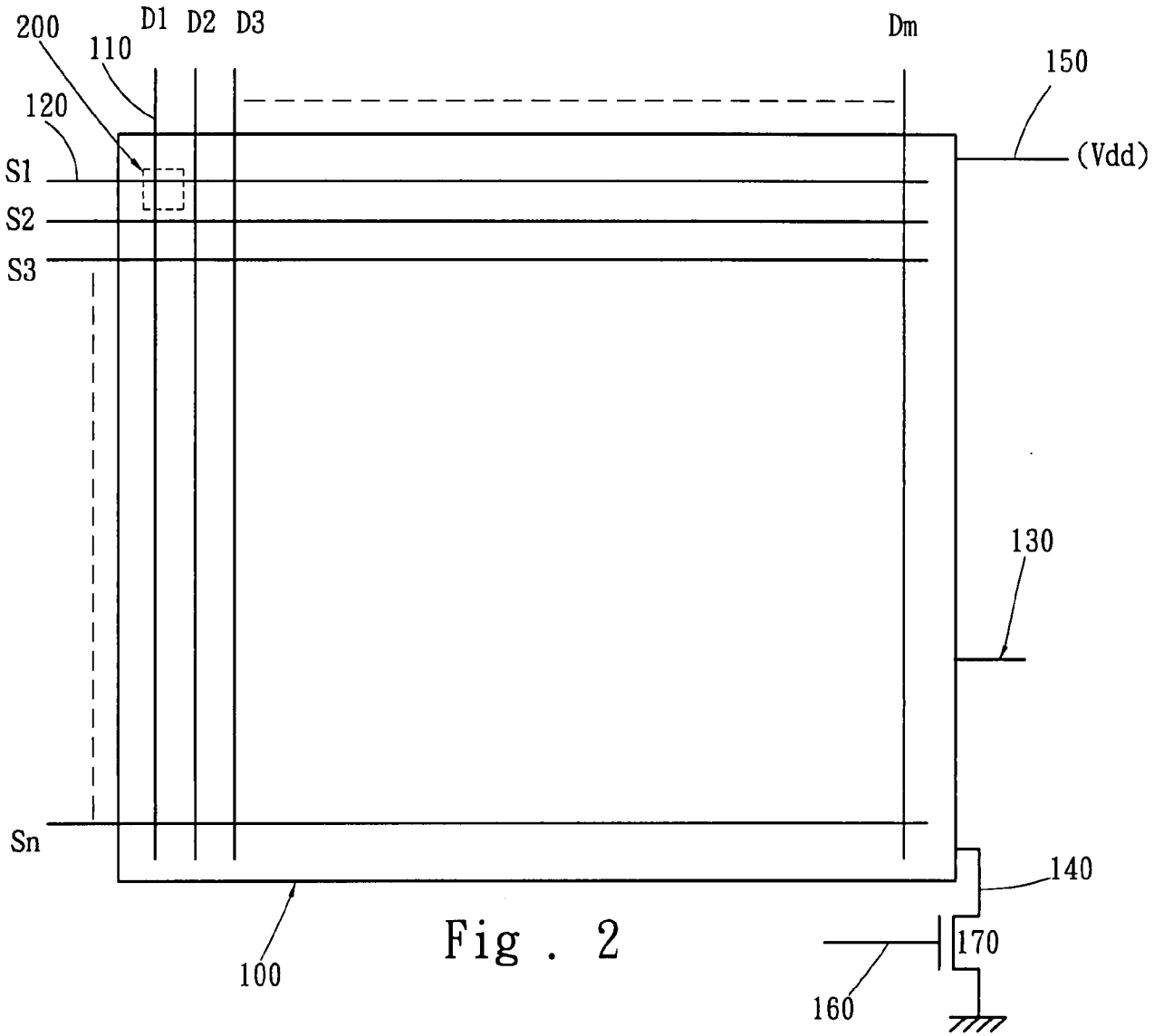
FIG. 2 is the connection and control of a pixel circuit in this invention.

Refer to FIG. 2 for connection and control of a pixel circuit in this invention. As the Figure shows: a joint where a scan line 120 (S1, S2, S3 . . . Sn) and a data line 110 (D1, D2, D3 . . . Dm) meet is a pixel 200. Refer to FIG. 1, FIG. 2. The gate of Scan TFT 210 is controlled by Scan Line 120 of the row where Pixel 200 is located, and the drain of Scan TFT 210 is connected to Data Line 110 of the column where Pixel 200 is situated. Reset TFT 220 and Detect TFT 230 are controlled by Threshold-Lock 130. Capacitor Cd is used to store data voltage (Vdata) of image signals and Capacitor Ct is used to store threshold voltage (Vth) of Drive TFT 240. Therefore, the sum of voltage stored in capacitors Cd and Ct will force Drive TFT 240 for an output of corresponding current to the organic electro luminescence element 250.

Reset TFT 220 and Detect TFT 230 of each Pixel 200 circuit on Display Substrate 100 are controlled by the same Threshold-Lock 130 and cathode of organic electro luminescence element 250 in every Pixel 200 is jointly connected to a Common Line 140, which is connected to the grounding end of the system via an external switch 170 controlled by a display signal line 160. Source of Drive TFT 240 in each Pixel 200 circuit is jointly connected to a supply line (Vdd) 150.

Figure 3:
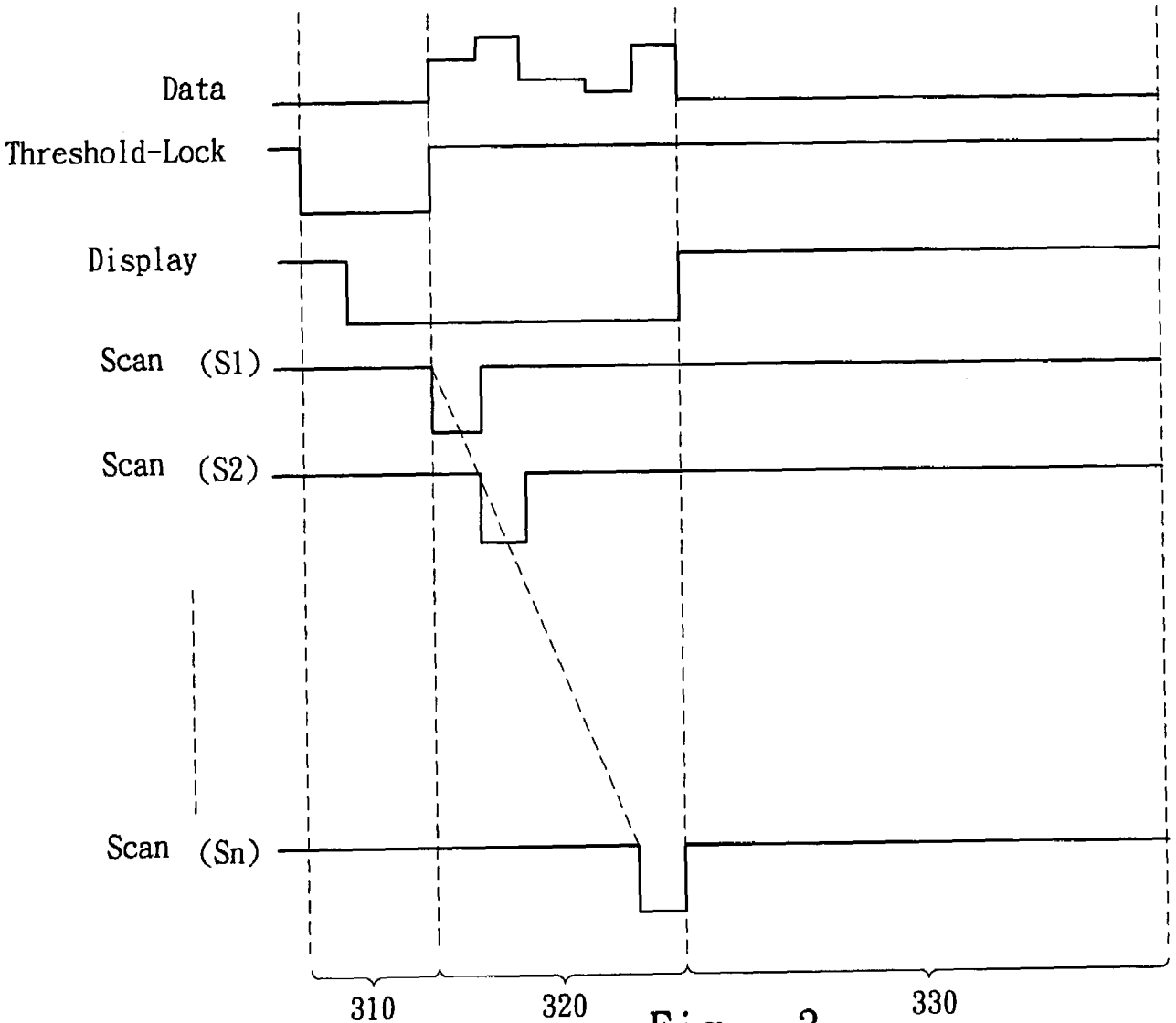
FIG. 3 is the sequences of control signals in this invention.
Figure 4:
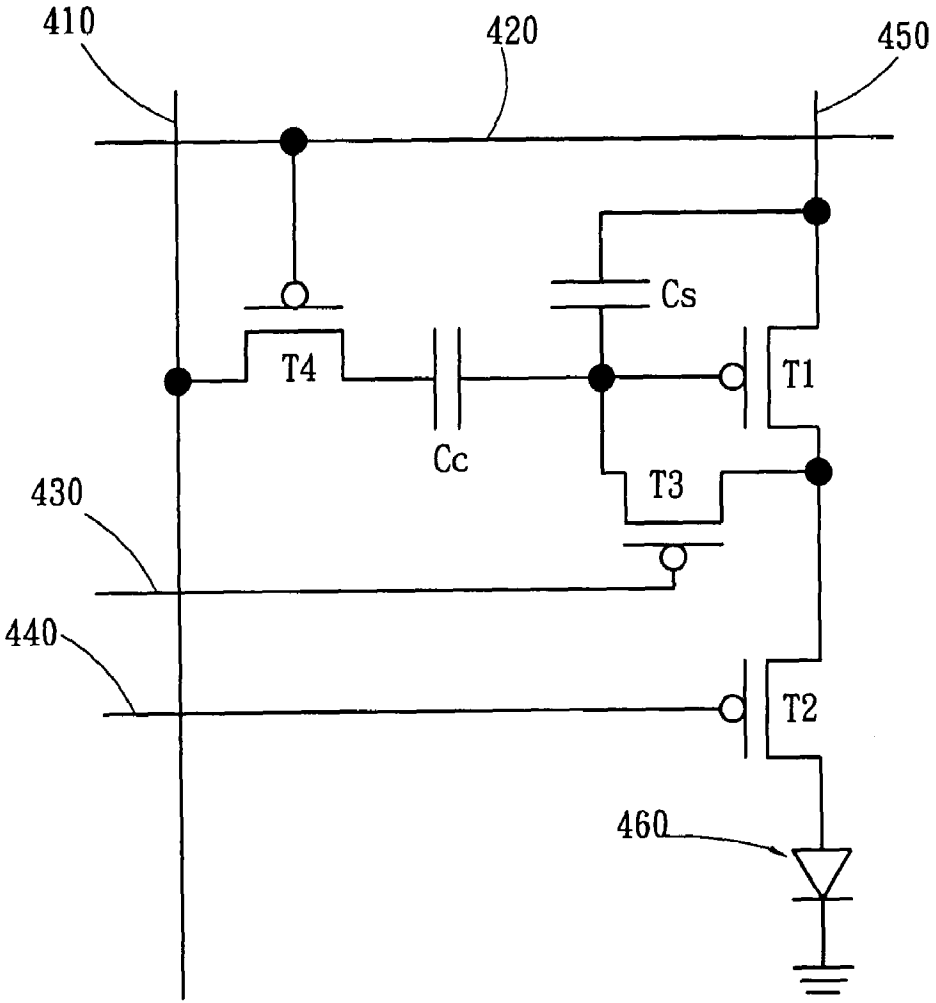
Fig. 4 PRIOR ART
FIG. 4 is a schematic pixel circuit diagram of U.S. Pat. No. 6,229,506.
Figure 5:
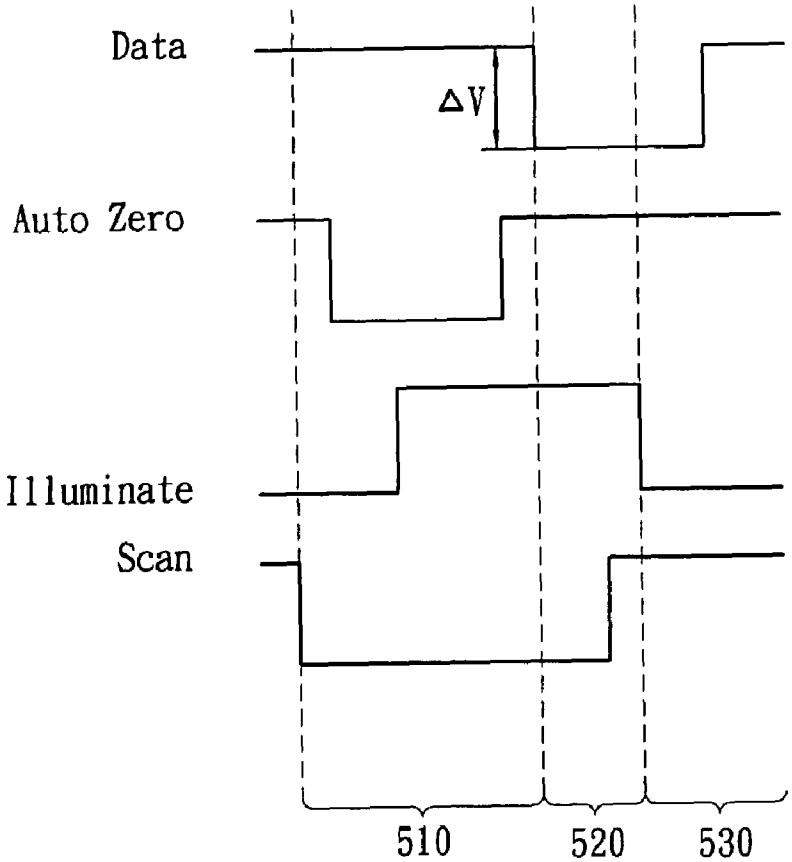
Fig. 5 PRIOR ART
FIG. 5 is a schematic diagram of control signal time sequence of U.S. Pat. No. 6,229,506.
Figure 6:
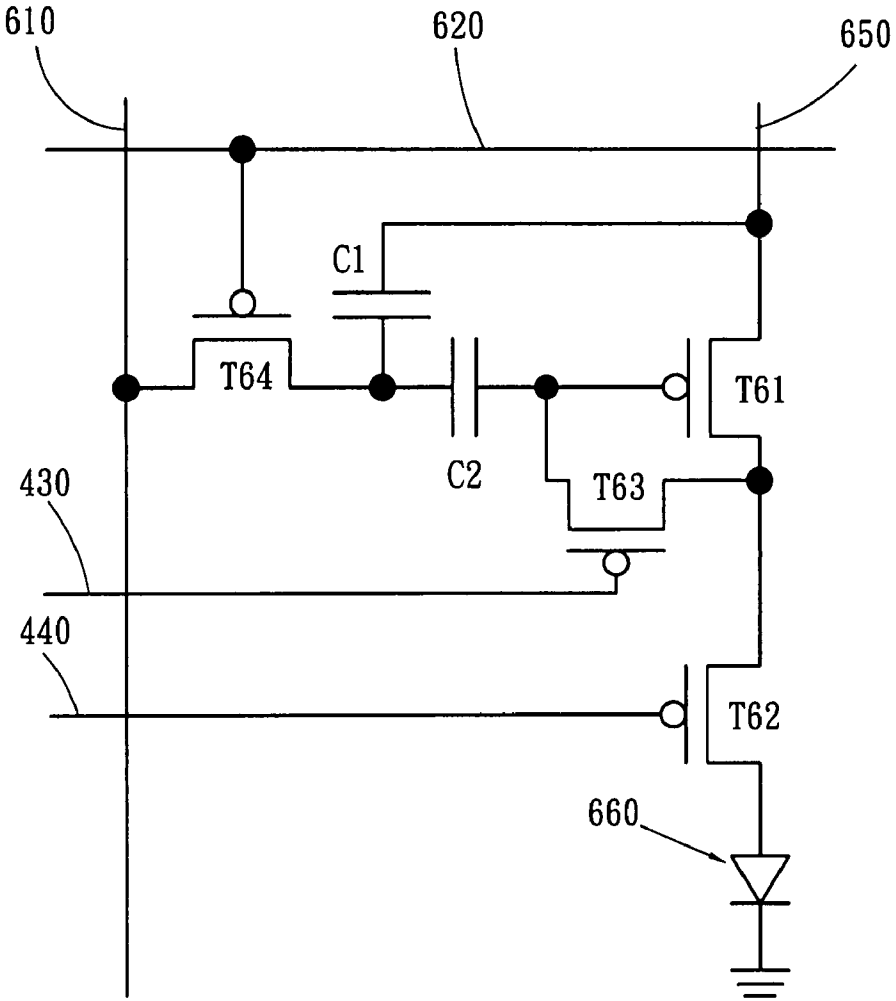
Fig. 6 PRIOR ART
FIG. 6 is the circuit of pixel in a thesis published by PHILIPS.

Actuation procedures of this invention are described as follows:

Refer to FIG. 3 for the sequences of control signals in this invention. A cycle of driving signals can be divided into three phases. First, Threshold-Lock Phase 310:

Signals of Threshold-Lock 130 will trigger Reset TFT 220 and Detect TFT 230 in every pixel circuit on. When Reset TFT 220 is on, Capacitor Cd storing voltage of image data will discharge. Display Signal Line 160 controls Switch 170 outside of Substrate 100 and makes it off. Thus, an open circuit exists between Common Line 140 and the grounding end of the system. Current of Drive TFT 240 stops flowing through organic electro luminescence element 250, but through Detect TFT 230 that is on at this moment, which forces Drive TFT 240 to detect threshold voltage. As current of Drive TFT 240 passes by Detect TFT 230, Capacitor Ct and Reset TFT 220, voltage stored in Capacitor Ct becomes smaller and smaller, which also makes current of Drive TFT 240 become smaller until no current is left.

At last, Capacitor Cd won't store any electric charge (0 voltage on both ends) and voltage difference on both ends of Capacitor Ct will equal to threshold voltage (Vth) of Drive TFT 240; i.e. when Capacitor Cd discharges and resets, Capacitor Ct will memorize threshold voltage (Refer to FIG. 1 for Pixel 200 circuit.). In summary, threshold voltage (Vth) of Drive TFT 240 in every Pixel 200 circuit will be stored in its own Capacitor Ct after Threshold-Lock Phase 310.

Next, signals of Threshold-Lock 130 will trigger Reset TFT 220 and Detect TFT 230 in every Pixel 200 circuit off for the following Write Phase 320.

In Write Phase 320, each Scan Line 120 (S1, S2 . . . Sn) will send out scan signals in order. When scan signals shift to Scan Line 120, all Scan TFT 210 on the same scan line will be on and Reset TFT 220 and Detect TFT 230 will be off. Data voltage (Vdata) of Data Line 110 can be stored into Capacitor Cd as Scan TFT 210 is on; however, threshold voltage (Vth) previously memorized by Capacitor Ct will still be retained as Reset TFT 220 and Detect TFT 230 are off. Thus, voltage difference between two ends of Capacitor Cd will be equivalent to supply voltage (Vdd) minus data voltage (Vdata); i.e. voltage at both ends of Capacitor Cd is (Vdd−Vdata).

Therefore, the sum of voltage stored in capacitors Cd and Ct will equal to (Vdd−Vdata+Vth), which will enable Drive TFT 240 to output corresponding current to organic electro luminescence element 250 in the following phase (Display Phase 330). Consequently, the current (I) can be expressed with a formula as follows:

$$I=(1/2)\times\hat{a}\times(\mathrm{Vsg}-\mathrm{Vth})^2$$

$$I=(1/2)\times\hat{a}\times(\mathrm{Vdd}-\mathrm{Vdata}+\mathrm{Vth}-\mathrm{Vth})^2$$

$$I=(1/2)\times\hat{a}\times(\mathrm{Vdd}-\mathrm{Vdata})^2$$

From the above equations (â is the Transconductance Parameter of Drive TFT 240), the current (I) generated by Drive TFT 240 is irrelevant to the threshold voltage (Vth) of its own, but only correlated to write data voltage (Vdata). Thus, threshold voltage differences of TFT resulted from process factors can be compensated.

When the last Scan Line 120 (Sn) completes writing data voltage (Vdata), Display Signal Line 160 will control Switch 170 and make it on and Common Line 140 will be connected to the grounding end of the system for the third stage of Display Phase 330.

In Display Phase 330, Drive TFT 240 in each Pixel 200 circuit will output Current (I) related to written data voltage (Vdata) to organic electro luminescence element 250, which produces proper luminance. Output Current (I) is not related to threshold voltage (Vth) of Drive TFT 240.

In comparison with the U.S. Pat. No. 6,229,506, the technology of loading data voltage realized in this invention can be applied to TFT-LCD Source IC (Voltage Mode) that is popular currently and avoids complexity.

To compare with the thesis published by PHILIPS with the subject of A Comparison of Pixel Circuits for Active Matrix Polymer/Organic LED Displays, the technology of this invention is to record all threshold voltage into one capacitor (capacitor Ct) to offset the effect of threshold voltage differences.

Furthermore, as the critical component parts of AMOLED like TFT-OLED Data IC are not well developed at present, the well-developed technology of TFT-LCD Source IC is required to support TFT-OLED application. However, TFT-LCD Source IC adopts voltage modulation; thus, design of a voltage driving circuit is required.

Two capacitors (Cd & Ct) are used in this invention to deal with two different things. One capacitor Ct is responsible to record all threshold voltage values (Vth) and the other capacitor Cd is in charge of recording all data voltage values (Vdata). It is different from U.S. Pat. No. 6,229,506 as the capacitor Cs has to record all threshold voltage (Vth) and part of data voltage (Vdata) loaded. It is also different from the thesis released by PHILIPS as capacitors C1 and C2 record threshold voltage jointly. Part of threshold voltage stored in Capacitor C1 will be lost since Capacitor C2 only records part of threshold voltage.

To conclude, the AMOLED driving circuit of this invention has the following advantages:

1. As all threshold voltage values (Vth) can be stored in one capacitor Ct (threshold voltage storage capacitor), the effects of threshold voltage differences can be compensated completely.

2. The technology of loading data voltage (Vdata) realized in this invention can be achieved by TFT-LCD Source IC (Voltage Mode) that is popular currently and avoids complexity.

What is claimed is:

1. A driving circuit of active matrix organic electroluminescence display is disclosed and a driving circuit of each pixel on a display panel includes:

a scan TFT, the gate of the Scan TFT connected to a Scan Line and drain connected to a Data Line;

a reset TFT, the gate of the Reset TFT connected to a Threshold-Lock, source connected to a Supply Line and drain connected to source of the Scan TFT;

a capacitor Cd, having two ends installed between source of the Scan TFT and source of the Reset TFT;

a drive TFT, the source of the Drive TFT connected to the Supply Line;

a detect TFT, the gate of the Detect TFT connected to the Threshold-Lock, drain connected to the gate of the Drive TFT and source connected to the drain of the Drive TFT;

a capacitor Ct, having two ends installed between the drain of the Reset TFT and the gate of Drive TFT;

an organic electroluminescence element, the anode of the organic electroluminescence element connected to the drain of the Drive TFT and cathode connected to a Common Line;

a switch on the display panel is used to connect the Common Line and the grounding end.

2. The driving circuit of active matrix organic electroluminescence display according to claim 1, wherein the Reset TFT and Detect TFT of each pixel circuit on a display substrate are controlled by the same Threshold-Lock.

3. The driving circuit of active matrix organic electroluminescence display according to claim 1, wherein the cathode of organic electroluminescence element in every pixel circuit is jointly connected to a Common Line.

4. The driving circuit of active matrix organic electroluminescence display according to claim 1, wherein the switch is a thin film transistor (TFT).

5. The driving circuit of active matrix organic electroluminescence display according to claim 1, wherein the switch is controlled by a Display Signal Line.

* * * * *